US008341094B2

(12) United States Patent
Haug

(10) Patent No.: US 8,341,094 B2
(45) Date of Patent: Dec. 25, 2012

(54) FRANKING MACHINE

(75) Inventor: Werner Haug, Langnau im Emmental (CH)

(73) Assignee: Frama AG, Lauperswil (CH)

( * ) Notice: Subject to any disclaimer, the term of this patent is extended or adjusted under 35 U.S.C. 154(b) by 3589 days.

(21) Appl. No.: 10/009,680

(22) PCT Filed: Feb. 22, 2001

(86) PCT No.: PCT/CH01/00116

§ 371 (c)(1),
(2), (4) Date: Oct. 20, 2001

(87) PCT Pub. No.: WO01/62504

PCT Pub. Date: Aug. 30, 2001

(65) Prior Publication Data

US 2003/0158825 A1 Aug. 21, 2003

(30) Foreign Application Priority Data

Feb. 23, 2000 (CH) ..... 345/00

(51) Int. Cl.
*G06Q 99/00* (2006.01)

(52) U.S. Cl. ..... 705/408; 705/410

(58) Field of Classification Search ..... 705/401, 705/408, 410

See application file for complete search history.

(56) References Cited

U.S. PATENT DOCUMENTS 4,168,533 A * 9/1979 Schwartz ..... 705/403
4,821,049 A 4/1989 Eckl
5,166,883 A 11/1992 Gilham
5,440,979 A 8/1995 Bonham et al.
5,806,994 A 9/1998 Coffy et al.
5,848,401 A * 12/1998 Goldberg et al. ..... 705/408
5,913,627 A 6/1999 Freeman et al.
6,106,094 A * 8/2000 Otani et al. ..... 347/19

FOREIGN PATENT DOCUMENTS

EP 0376575 A2 * 7/1990
EP 0376576 A2 * 7/1990

* cited by examiner

*Primary Examiner* — Akiba Allen
(74) *Attorney, Agent, or Firm* — Lucas & Mercanti, LLP; Klaus P. Stoffel

(57) ABSTRACT

The invention relates to a franking machine, comprising a print head of an ink-jet printing mechanism for printing flat postal items such as letters or postcards, which can be introduced into said mechanism or which pass through the same. Said franking machine consists of a guiding part which is located around the print head and projects in relation to the nozzle opening plane of said print head, and with which a conveying device is associated, said conveying device transporting the postal items between itself and conveying rollers lying opposite and rotating about axes that are located crosswise to the conveying direction. Said conveying device has two drive-connected driving rollers which together with the guiding part, form a path of travel. The driving rollers are located in front of and behind the print head in relation to the conveying direction. A reversibly liftable counter pressure roller located opposite exerts a pressure on each driving roller, respectively, or on a postal item being transported in-between. A roller feeler (39, 119) which is driven by the passing postal item and which is associated with an encoder device (122) is located between the driving rollers (13, 15; 127, 113) in order to monitor the speed and position of a postal item being transported or for controlling the pressure on a postal item.

3 Claims, 19 Drawing Sheets

FRANKING MACHINE

BACKGROUND OF THE INVENTION

1. Field of the Invention

The invention relates to a franking machine with at least one print head of an inkjet printing mechanism for printing flat postal objects, such as letters or postcards, inserted into or passing through the machine, comprised of a guide part arranged so as to project from the print head and relative to its jet opening plane and having correlated therewith a transport device for transporting the postal objects between it and oppositely positioned conveying rollers rotating about axes oriented transverse to the conveying direction, wherein the transport device comprises two drive rollers connected in driving connection with one another and forming together with the guide part a conveying path, which drive rollers, when viewed in the conveying direction, are arranged before and behind the print head and has a counterpressure roller arranged opposite thereto, respectively, which exerts a pressure against the drive roller or the postal object to be transported therebetween and which is reversibly liftable. The franking machines employ today in addition to the classical rotary printing technology increasingly new stamp application methods, inter alia, based on thermal or inkjet basis.

2. Description of the Related Art

It has been shown in practice that not only the print head must be replaced, but depending on the printing technology the entire franking machine configuration is subject to greater and very complex, i.e., also correspondingly expensive, changes and modifications.

Inkjet print heads have been known for quite some time and are used, in particular, in PC printers. The knowledge that has been gained for use of such print heads in this field cannot be transferred onto the present field of use in franking machines. The reasons, inter alia, lie in the high speed of the letters undergoing franking as well as their different formats and thicknesses as well as the considerably rougher conditions of the surroundings, caused partially by soiled surfaces of the postal objects. Moreover, these franking prints must fulfill strict quality requirements of the postal offices, which make necessary high construction expenditure and reliability.

SUMMARY OF THE INVENTION

The object of the present invention resides in that the franking machine is to be configured such that the printing mechanism enables a disruption-free printing for the franking of postal objects, such as letters, cards or the like of different thickness, different formats and materials, and an unequivocally identifiable print image. Since presently such machines must enable high throughput, a fully automated operation is also required.

Since from the thinnest objects (essentially a single sheet) to thick letters, a wide range of postal objects with most different mechanical properties—for example, bending behavior—as well as most different formats are to be printed or provided with franking, during the entire printing phase the printing must be adjusted or controlled with respect to the throughput speed or the travel distance covered by the postal object. In addition, conditions must be provided which ensure a great reliability and low-maintenance configuration.

According to the invention this object is solved in that a sensing wheel is arranged between the drive rollers which sensing wheel is driven by the postal object passing along it and is correlated with an encoding device for the purpose of speed and position monitoring of a transported postal object, respectively, for controlling printing on a postal object. In this way, with simple means a high precision during printing of the postal objects can be achieved.

In the following the functions and the configuration of an embodiment of the printing machine according to the invention is A described. For a better understanding, reference is being had to the reference numerals and Figures in which embodiments of the invention are illustrated.

1A forward control curve for right counterpressure roller
1B rear control curve for right counterpressure roller
2A forward control curve for left counterpressure roller
2B rear control curve for left counterpressure roller
3 main shaft
4 rear sidewall
5 forward sidewall
6A counterpressure lever, left, front
6B counterpressure lever, left, rear
7A control lever, left, front
7B control lever, left, rear
8A counterpressure lever, right, front
8B counterpressure lever, right, rear
9A control lever, right, front
9B control lever, right, rear
10 axle for counterpressure lever and control lever
11 stop bolt for counterpressure lever—right
12 stop bolt for counterpressure lever—left
13 counterpressure roller—right
14 support roller
15 counterpressure roller—left
16A linkage, front, for support roller
16B linkage, rear, for support roller
17 axle for linkage
18 rod for suspending spring
19 suspension location for spring
20 tension spring for control lever
21 support roller carrier with sensor member
22 cam follower
23 worm shaft
24 worm gear
25 forked light barrier
26 slotted disk
27 switching cam for initial position of main shaft
28 microswitch
29 control roller
30 tension spring for counterpressure lever
31 direct-current motor
32 drive roller, right
33 drive roller, left
34 axle for counterpressure roller, right
35 stop for cam follower
36 tension spring for cam follower
37 stop for sensor member
38 sensor wheel for incremental transponder
39 holding-down plate or guide part
40 drive motor for feed
41 gearbox for drive rollers
42 incremental transponder, encoder
43 projecting member on support roller carrier

DETAILED DESCRIPTION OF THE INVENTION

Figure 1:
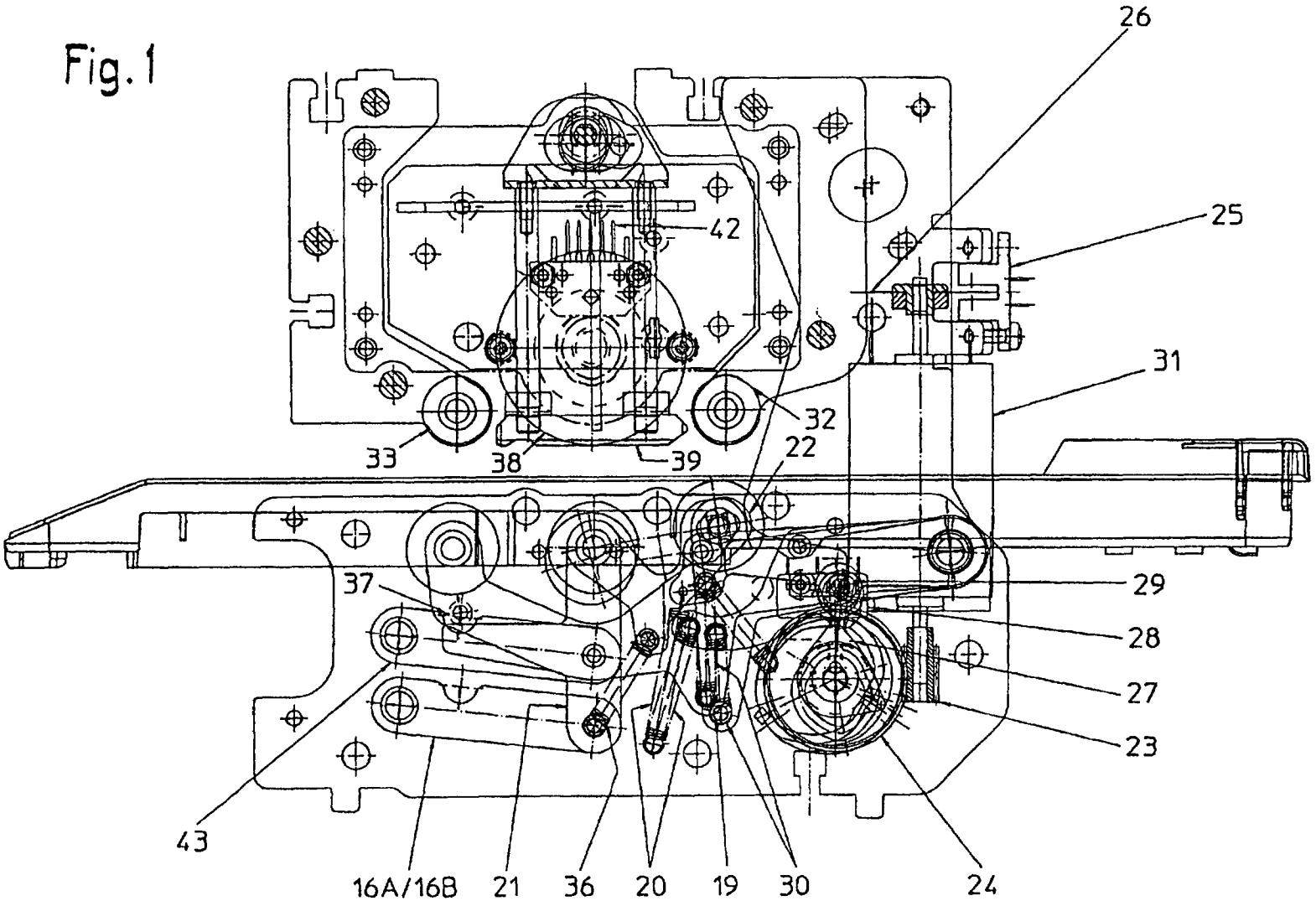
FIG. 1 front view of the complete counterpressure mechanism, including drive, sensor wheel, and main shaft drive.
Figure 2:
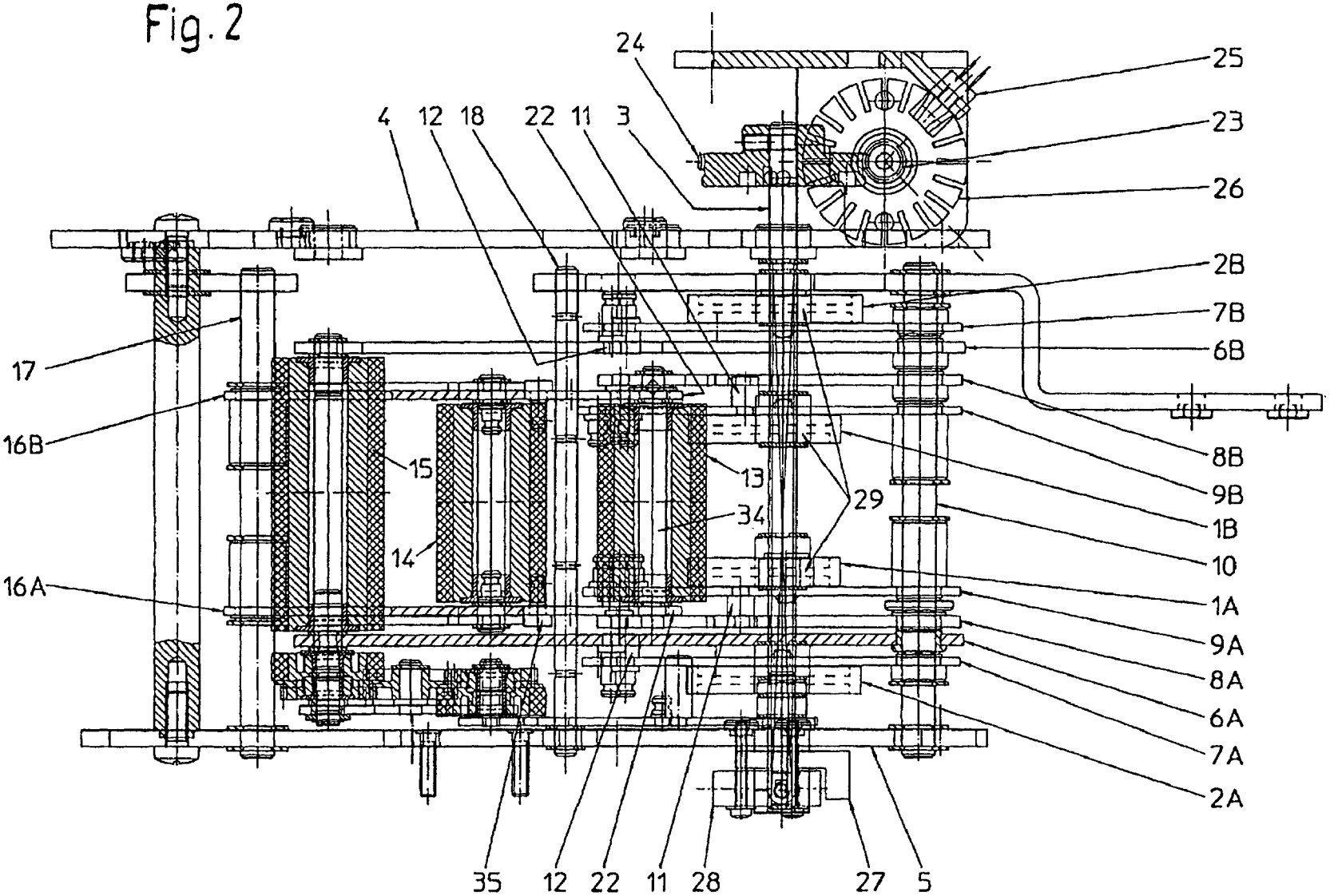
FIG. 2 plan view onto counterpressure mechanism according to FIG. 1.
Figure 3:
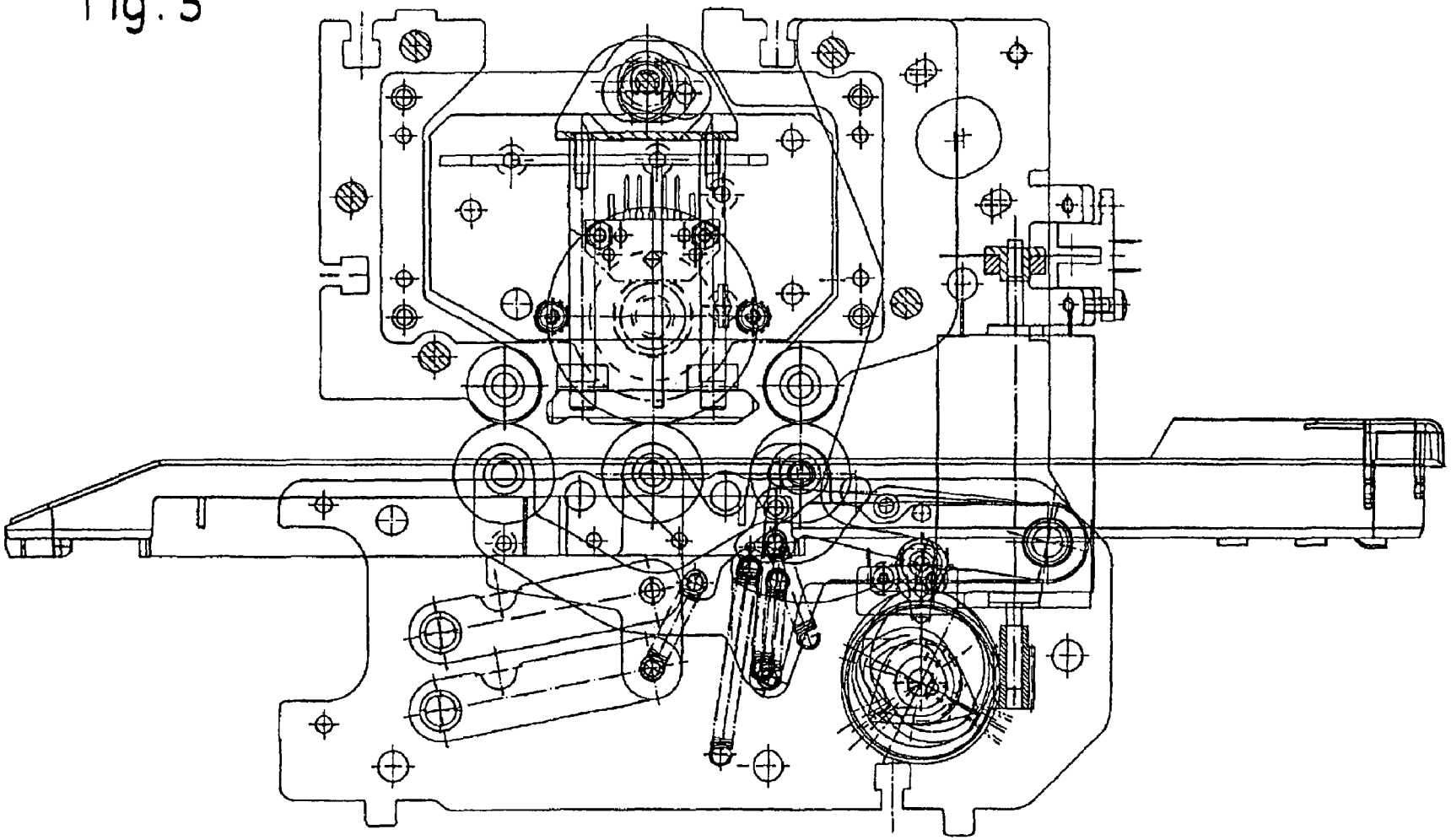
FIG. 3 front view of the complete counterpressure mechanism in franking position, counterpressure arrangement in upper position.
Figure 4:
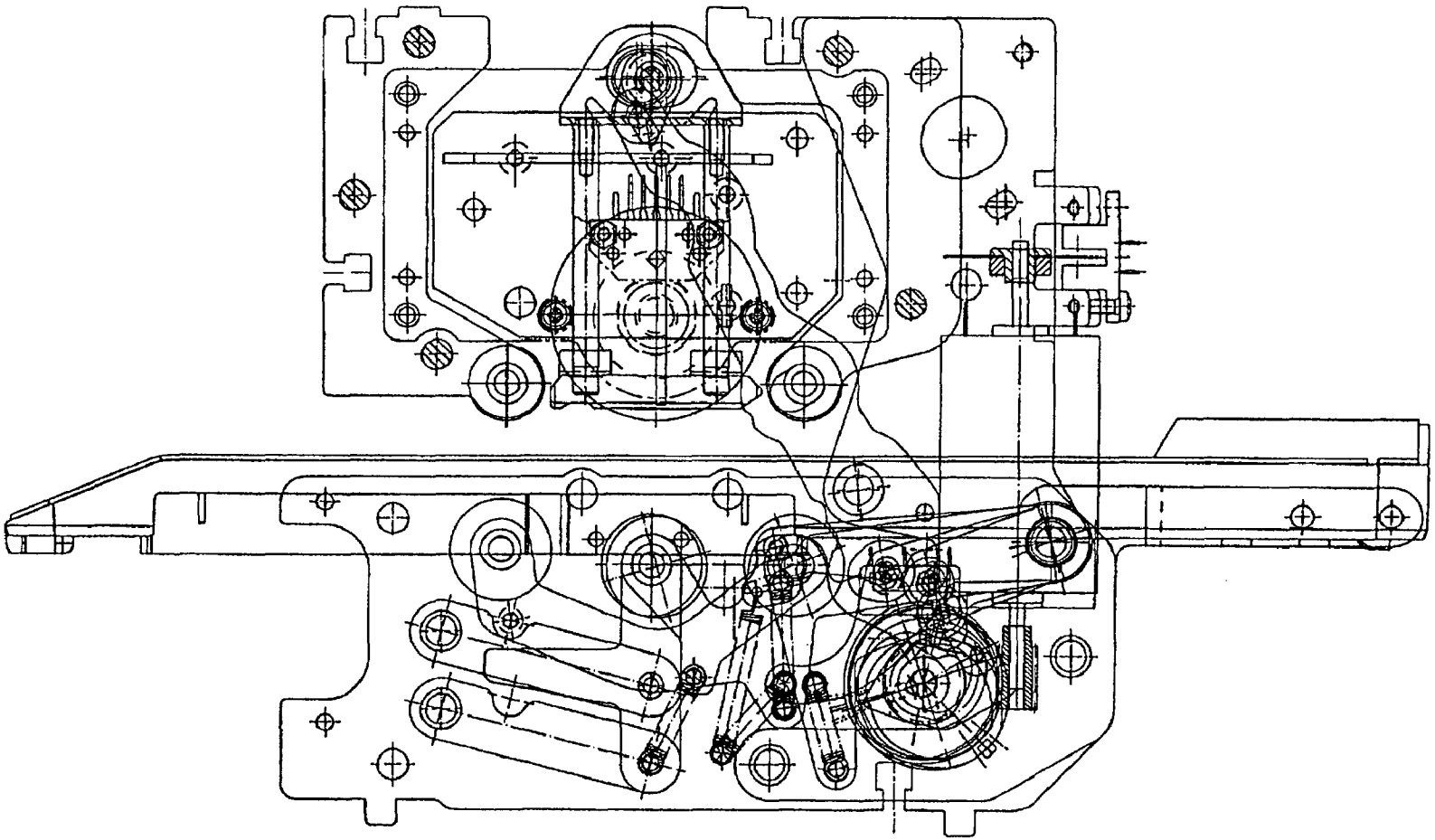
FIG. 4 front view of the complete counterpressure mechanism in service position, counterpressure arrangement in lowermost position.

In the case of franking of individual letters, the letter is inserted manually into the franking machine. Photo cells start the franking process when the envelope is correctly positioned. The counterpressure rollers which are in a lower position upon insertion of the envelope are moved upwardly by the control curves on the main shaft and press the letter object against the upper drive rollers. The letter transport or the franking process is started.

The counterpressure arrangement is comprised of two counterpressure rollers and an intermediately positioned support roller. The counterpressure rollers are positioned under the right and left drive rollers. The support roller has the object to secure the letter at the required height level under the print heads without pressing the letter against the end faces of the print heads so that the print image remains clean without smearing. After the franking process, the counterpressure rollers and the support roller move again downwardly and release the gap for the insertion of a new envelope.

In addition to the insertion and franking positions of the counterpressure rollers and the support rollers, there is also a position "service". In this position the counterpressure rollers are moved even farther downwardly in order to provide room for the service station. The service station cleans and closes the print heads for longer work interruptions. Moreover, it is required for filling the print heads when changing the ink bag.

On the main shaft 3 several control curves 1A, 1B and 2A, 2B are arranged which lift or lower, depending on the required position, the control levers 7A, 7B and 9A, 9B via the control rollers 29 so as to be pivoted about the axle 10. The initial position of the main shaft 3 is found by the microswitch 28 switched by the control cam 27. By means of the motor 31 the worm gear mechanism 23/24 is driven and the main shaft is rotated into the position "insertion of letter", "franking", or "service position". The precise position is reached by a forked light barrier 25 and the slotted disc 26 seated on the motor shaft by means of electronic control. The counterpressure levers to the right and left 6A, 6B and 8A, 8B are pivoted by the tension springs 30 connected to the control levers 7A, 6B and 9A, 9B in the upward direction about the axle 10 until the counterpressure rollers 13, 15 come to rest against the upper drive rollers 32, 33. The control levers 7A, 7B and 9A, 9B reach their end positions via the control curves 1A, 1B and 2A, 2B which has the result that the tension springs 36 are further pretensioned by a small amount. The safe contact between the control rollers 29 and the control curves 1A, 1B and 2A, 2B is achieved by the tension springs 29 connected to the spring suspension rod 18. The precise lower position of the counterpressure levers 6A, 6B and 8A, 8B is reached at the stop bolts 11, 12 on the control levers which are supported on the counterpressure levers after a short return stroke and entrain them in the downward direction. The corresponding positions are illustrated in detail in the Figures.

The support roller 14 positioned at the center, which moves the letter to an exact spacing relative to the inkjet print heads, is seated rotationally supported on two support roller carriers 21 which are, in turn, supported by means of two parallelogram linkages 16A, 16B. The cam follower 22 seated on the rotation axle of the support roller 14 is connected to the axle 34 of the right counterpressure rollers 13 and is forced to move in the downward direction when lowering the right counterpressure lever 6A, 6B and reaches the level of the right counterpressure roller. The cam follower 22 is supported via the stop 35 against the support roller carrier 21 rigidly in regard to rotation to the left. With regard to rotation to the right, the cam follower 22 can rotate away from the stop 35 counter to the force of the tension spring 36. This is required because of the mutual sensing between the right and the left counterpressure rollers and will be described in more detail later on.

Description of FIGS. 1 to 8:

The counterpressure levers are in the initial position ready for insertion of an individual letter. As soon as the letter is positioned in an exact position to the rear and the right defined by the table stop, the franking machine is activated by means of a reflective light barrier. First the main shaft 3 rotates about approximately one-third revolution in the clockwise direction. The control levers 7, 9 are pivoted upwardly by the control rollers 29 by means of the control curves 1, 2. The counterpressure levers are also moved upwardly via the tension springs 30 until the counterpressure rollers 13, 15 rest against the drive rollers 32, 33. The control levers move still farther until the control curve has reached its highest point. The possible overstroke of the control lever is compensated by the sprung coupling of the counterpressure levers. The support roller 14 has been adjusted by means of the cam follower 22 to the same level. The letter is now clamped between the drive rollers and the counterpressure rollers. The drive motor 40 (see FIG. 8) drives via the gear mechanism 41 the drive rollers 31, 33 and moves the letter from the right to the left. The speed and position detection is realized by the incremental transponder 42 and the sensing wheel 38. The sensing wheel is driven by friction by means of the moving envelope and detects thus the precise speed of the letter surface. The pressing of the letter against the sensing wheel is realized by a separate counterpressure arrangement which will be described separately in the following. As a function of the letter position, the inkjet print heads spray corresponding line patterns which result in the desired print image. The holding-down plate or the guide part 39 secures the letter at an exact spacing to the print head end face in order to enable with respect to resolution a clean print image and, furthermore, to prevent that the printed lines smear when moving the envelope. After completion of the franking process the drive motor 40 is switched off and the main shaft 3 returns by rotation into its initial position; the counterpressure levers 6A, 6B; 8A, 8B reach again their initial position. A new letter can be inserted. The main shaft 3 rotates between the position "insertion" and "franking" only by approximately one-third revolution back and forth, which provides a considerable time advantage and moreover is gentle on the mechanism. After a further one-third revolution the counterpressure rollers have reached their absolute lowest position as is required in the service position (see FIG. 4). Movement back into the initial position "insertion" requires also only one-third revolution.

Figure 5:
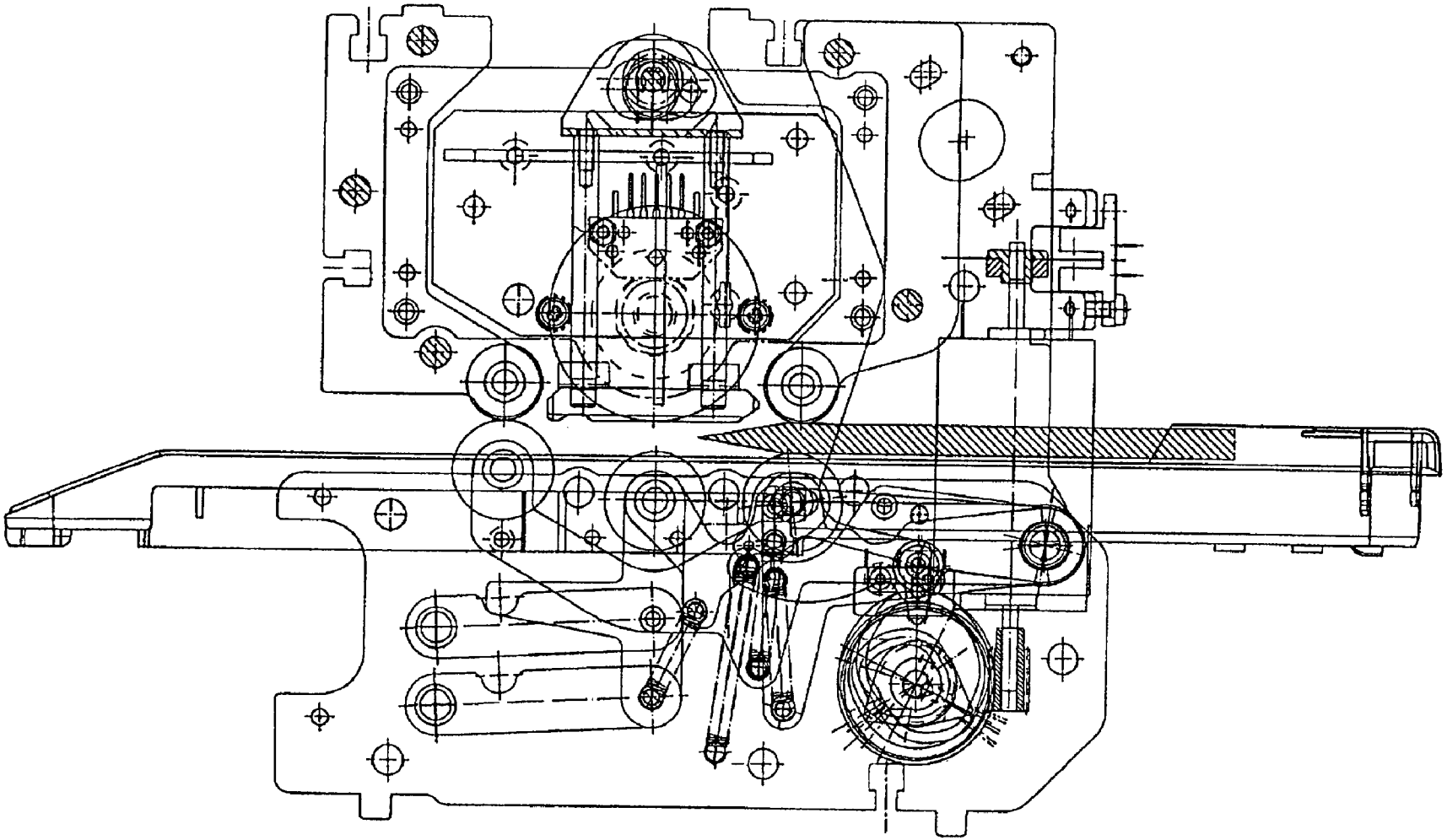
FIG. 5 front view, position of counterpressure lever/rollers with inserted thicker short letter or letter being fed from the right by automatic feeding into a position under the right drive roller.

In FIG. 5 the function of the cam follower in connection with the right counterpressure roller is illustrated. The necessity of this function is described in the following. The initial position is characterized by a relatively thick short envelope which is inserted manually. The franking machine triggers the franking process. The counterpressure levers move, as described, in the upward direction. The thickness of the short letter limits the stroke of the right counterpressure roller in the upward direction. The letter is clamped by means of the spring force that is built up by the tension spring 19 between the upper right drive roller 32 and the counterpressure roller 13. This is necessary in order to ensure a slip-free drive. If the support roller 14 were not moved automatically by means of the cam follower 22 to the same height level, the thick envelope could not be clamped between the upper stationary holding-down plate or the guide part, 39 and the support roller; this would result in transport problems and printing quality loss. By means of the already described cam follower 22 the support roller carrier with support roller is moved to the height level of the right counterpressure roller. The support roller carrier moves synchronously in the form of a parallelogram with the right counterpressure roller in the downward direction and the envelope can pass without friction through the printing station.

Figure 6:
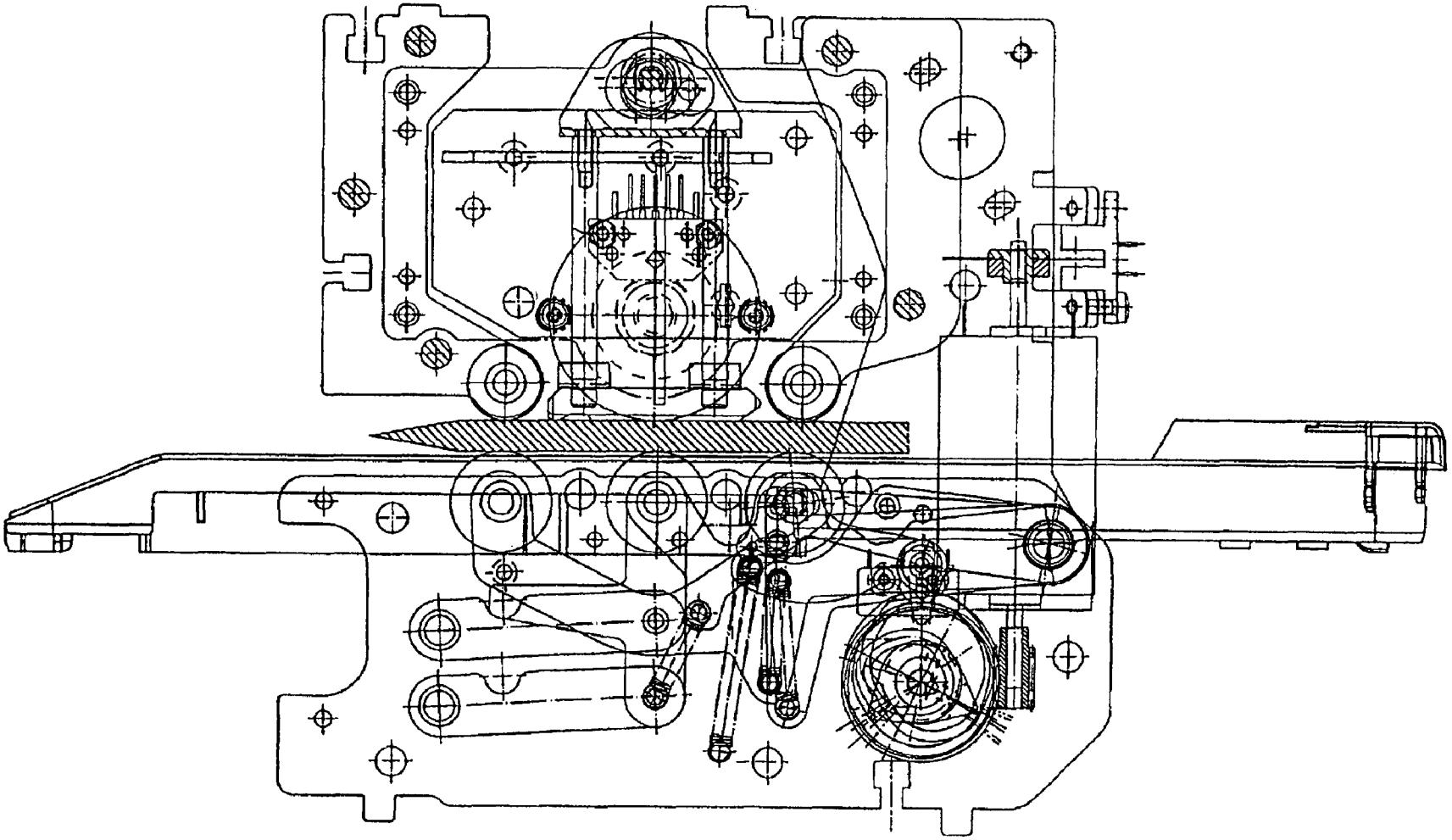
FIG. 6 front view, thick letter underneath all drive rollers and the sensor wheel.

In FIG. 6 the illustration shows the thick letter having been moved also under the left drive roller. The left counterpressure lever had to move also in the downward direction counter to the spring force and has reached the same height level as the right counterpressure lever or the central support roller. The stop 37 of the left counterpressure roller has contacted the sensing member of the support roller carrier 21.

Figure 7:
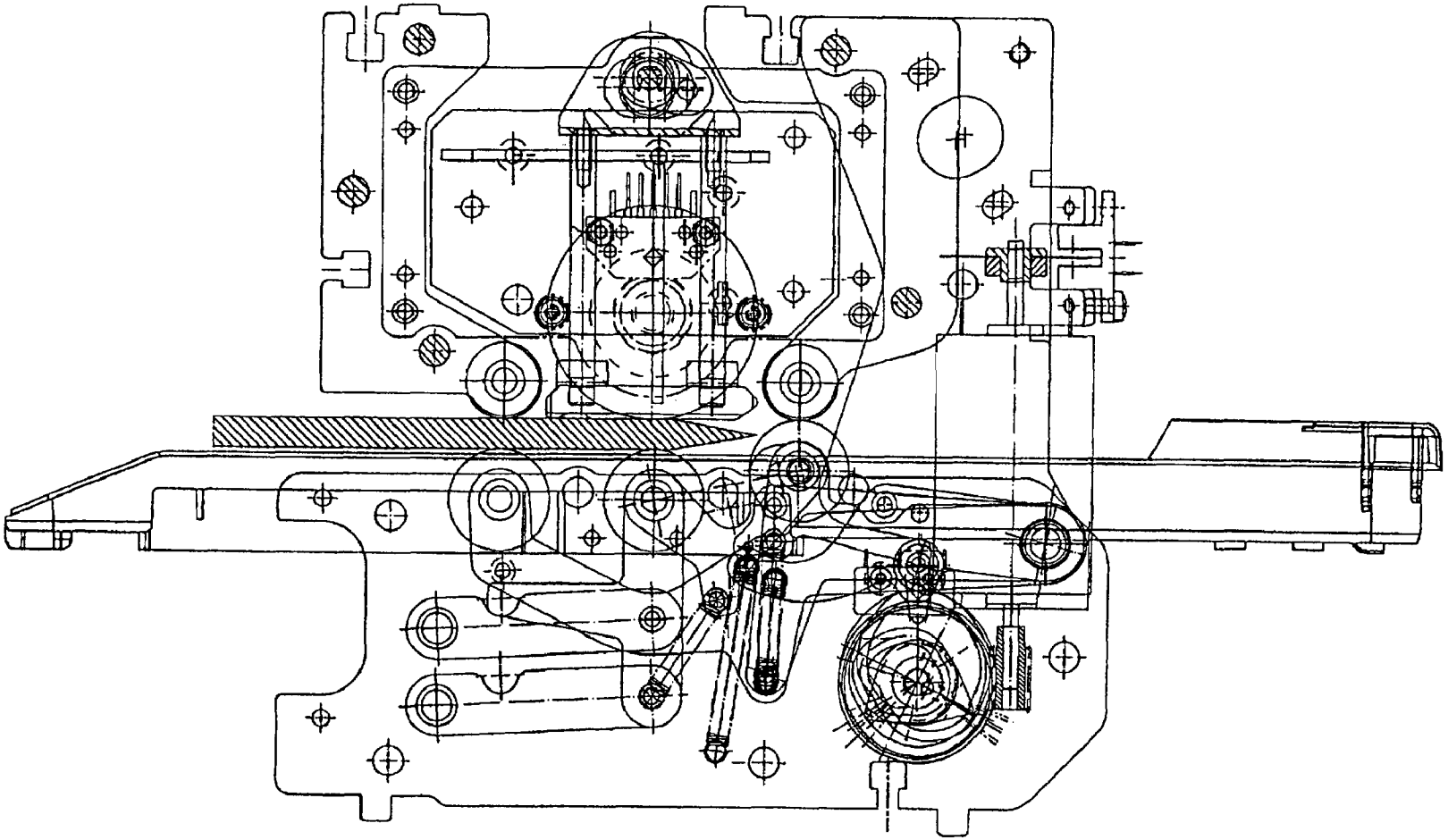
FIG. 7 front view, thick letter has left the right roller, the right counterpressure roller automatically reaches the upper position, the central support roller remains at the initial height level. The left counterpressure roller has taken over the height sensing.
Figure 8:
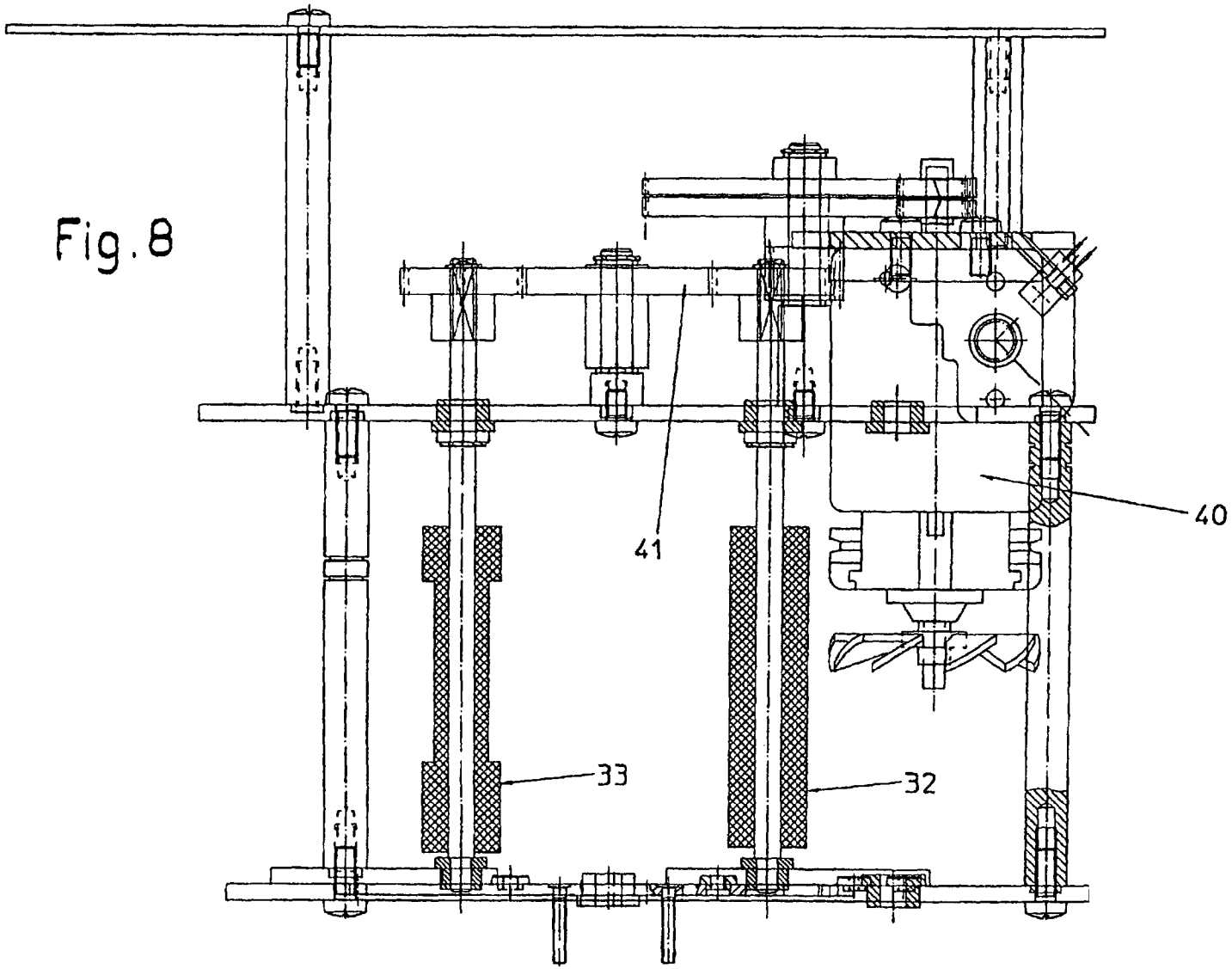
FIG. 8 plan view, drive rollers with feed gear mechanism.

In FIG. 7, the letter has left the right drive roller and the right counter roller moves again upwardly until the counterpressure roller contacts the upper drive roller. The stop 37 of the left counterpressure roller rests against the projecting member 43 of the support roller carrier 21 and secures it now at the original height level. The right cam follower 22 can fold out by rotating to the left and the connecting point can follow the right counterpressure roller until the counterpressure roller rests against the upper right drive roller. The height sensing of the support roller is realized alternatingly between the right and left counterpressure roller and ensures thus over the entire letter length an optimal friction-free spacing relative to the print heads and the holding-down plate or the guide part 39.

Figure 9:
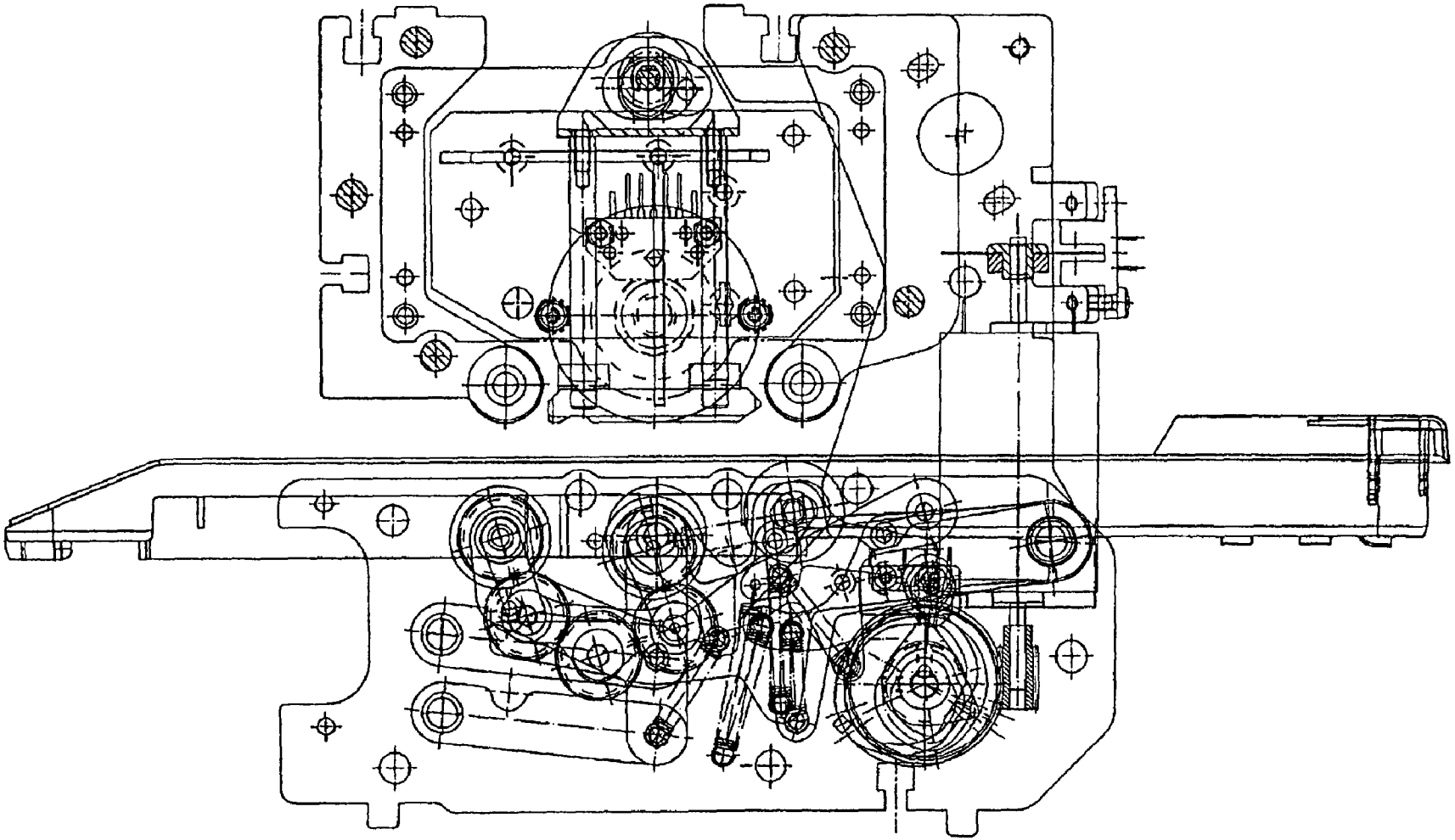
Figure 10:
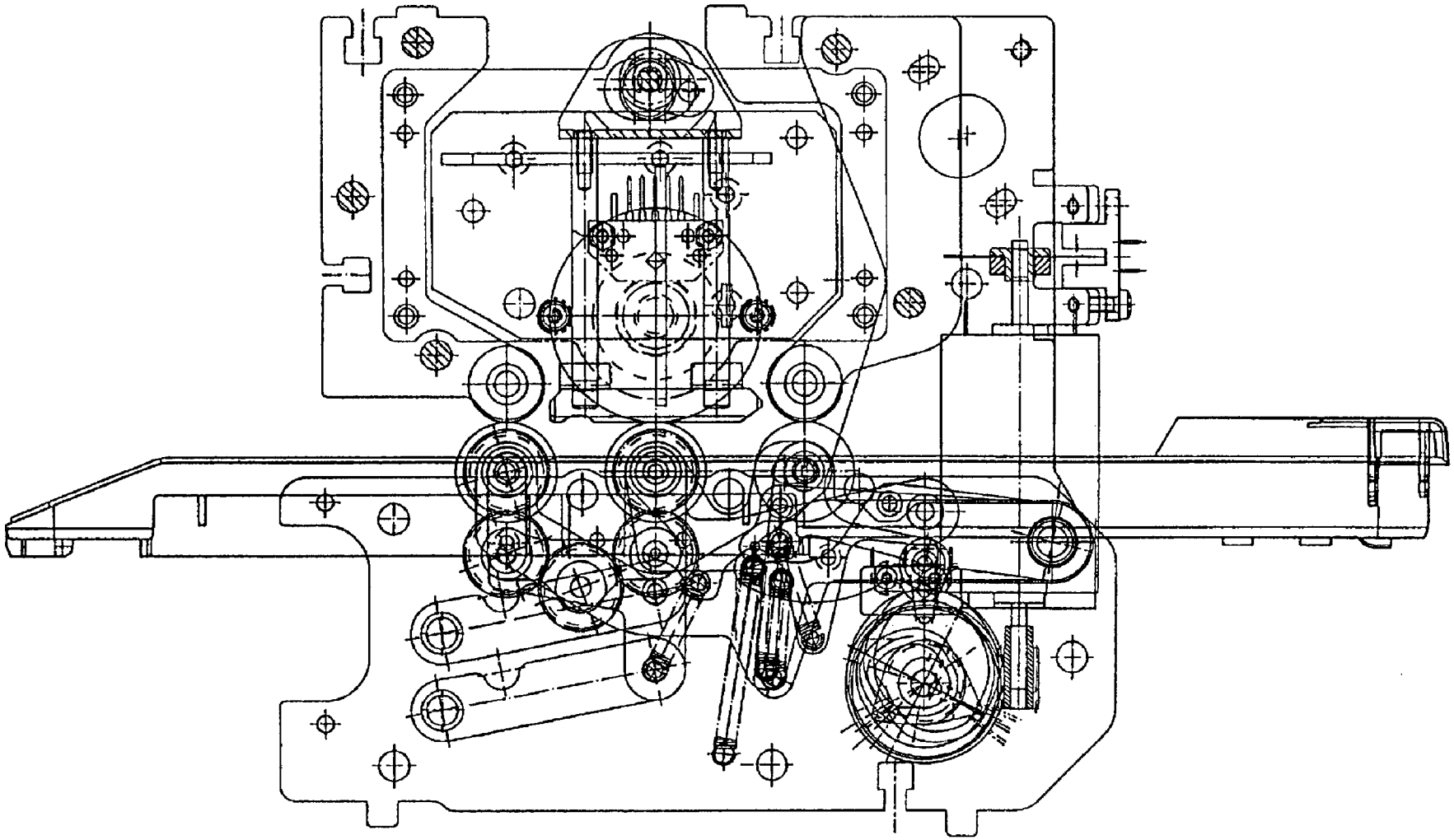
Figure 11:
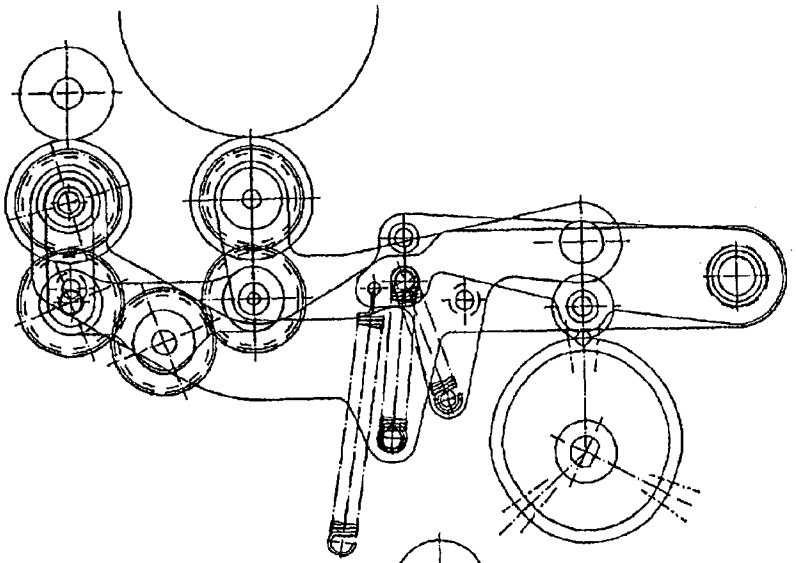
Figure 12:
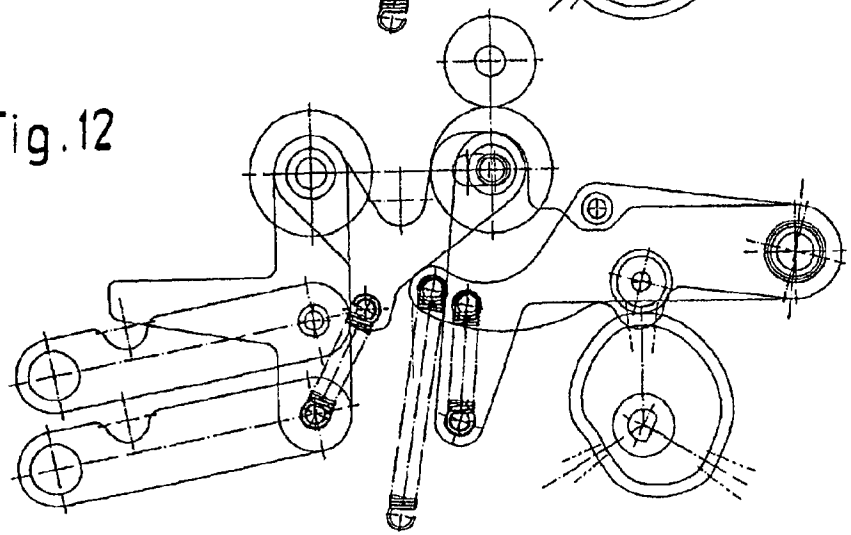
Figure 13:
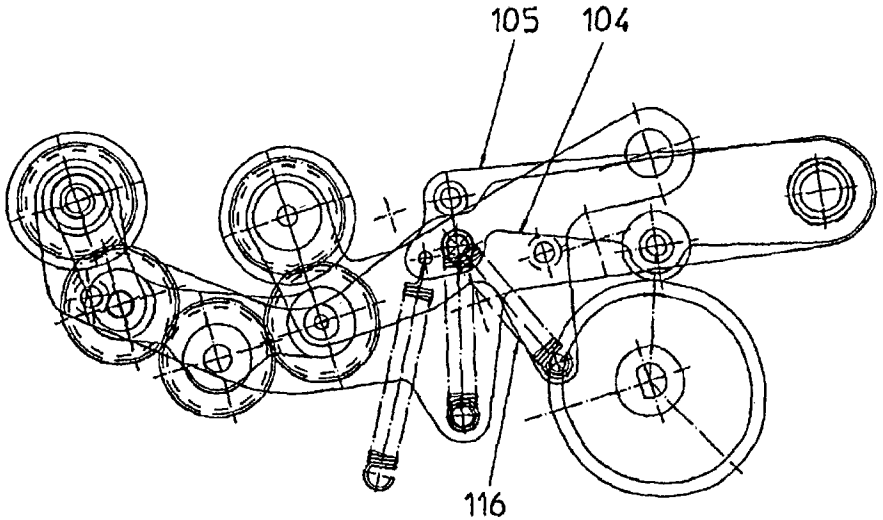
Figure 14:
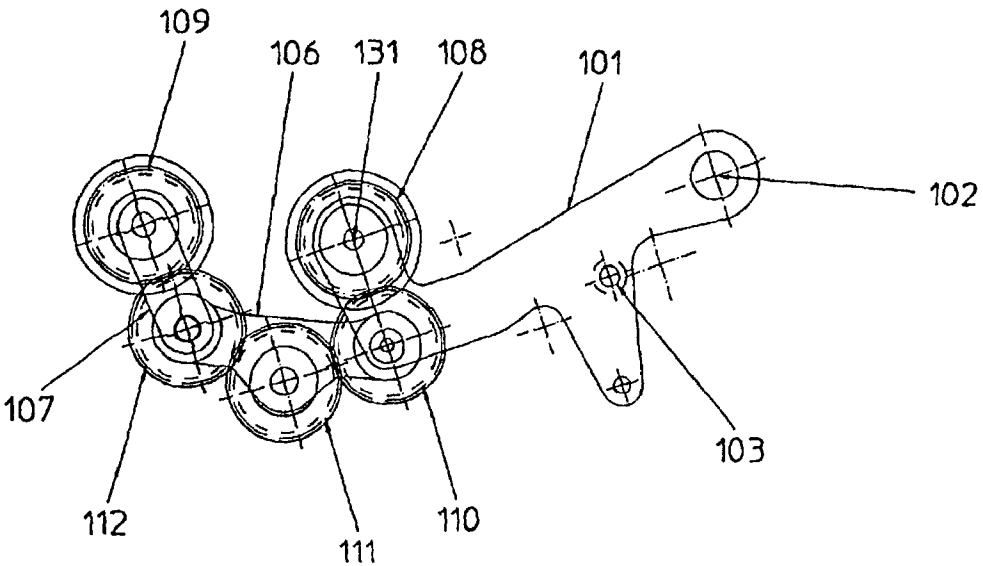
Figure 15:
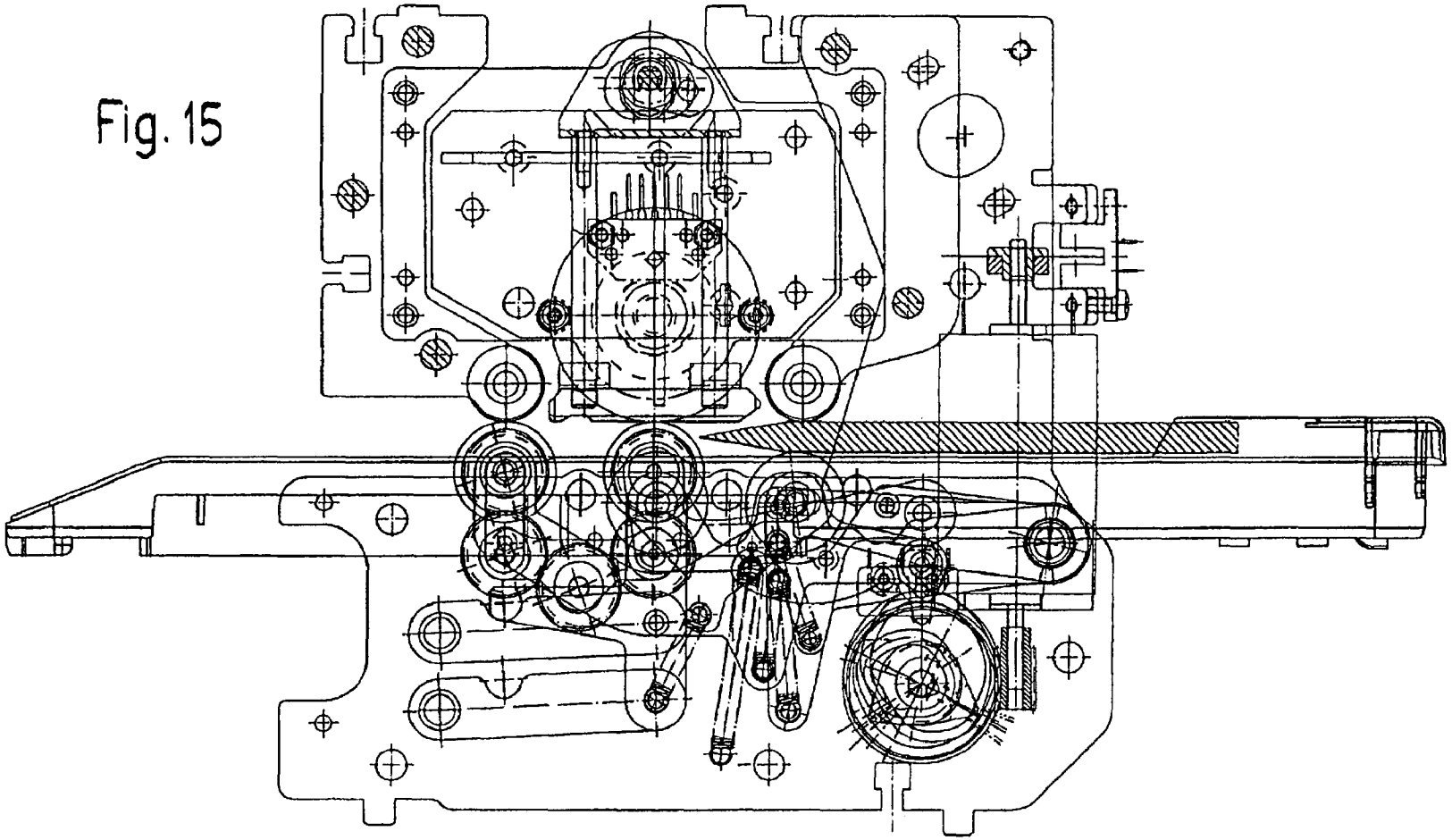
Figure 16:
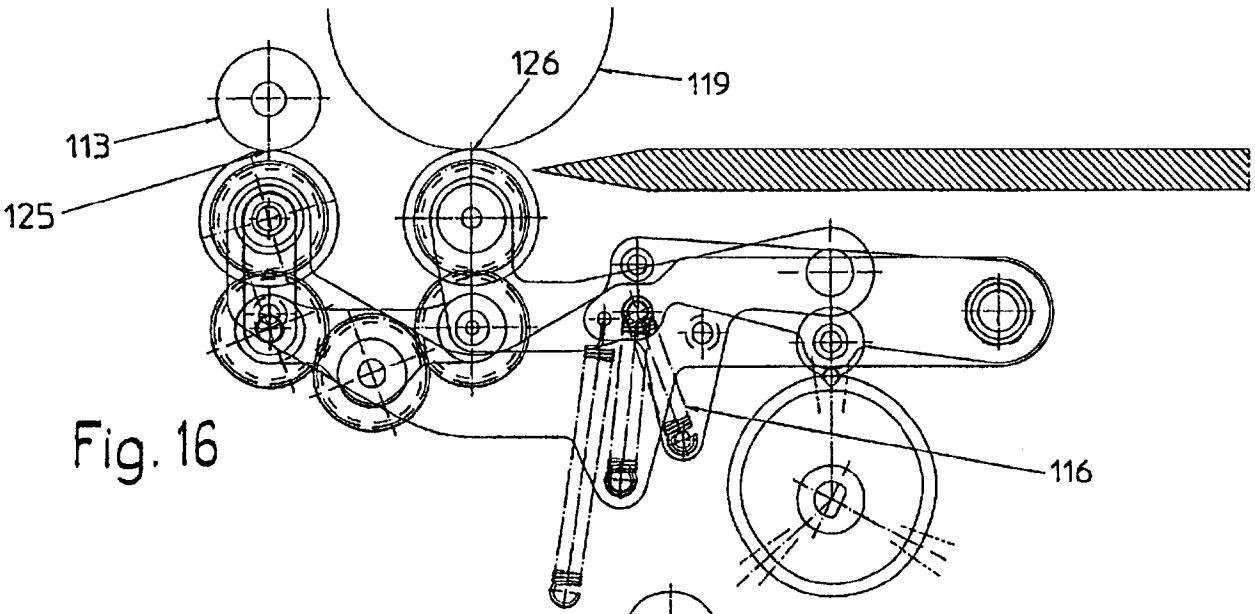
Figure 17:
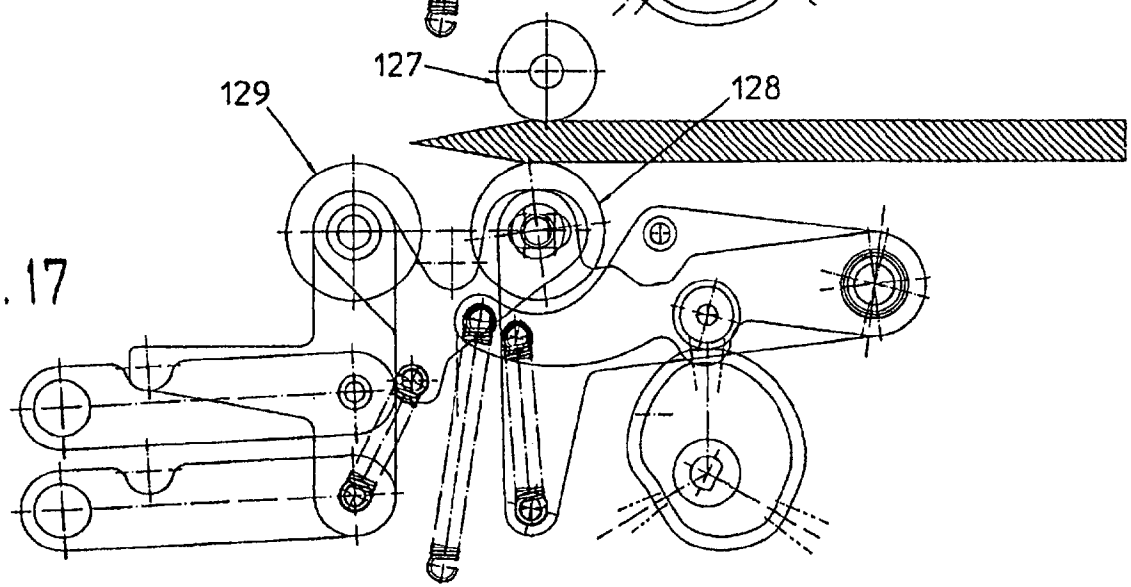
Figure 18:
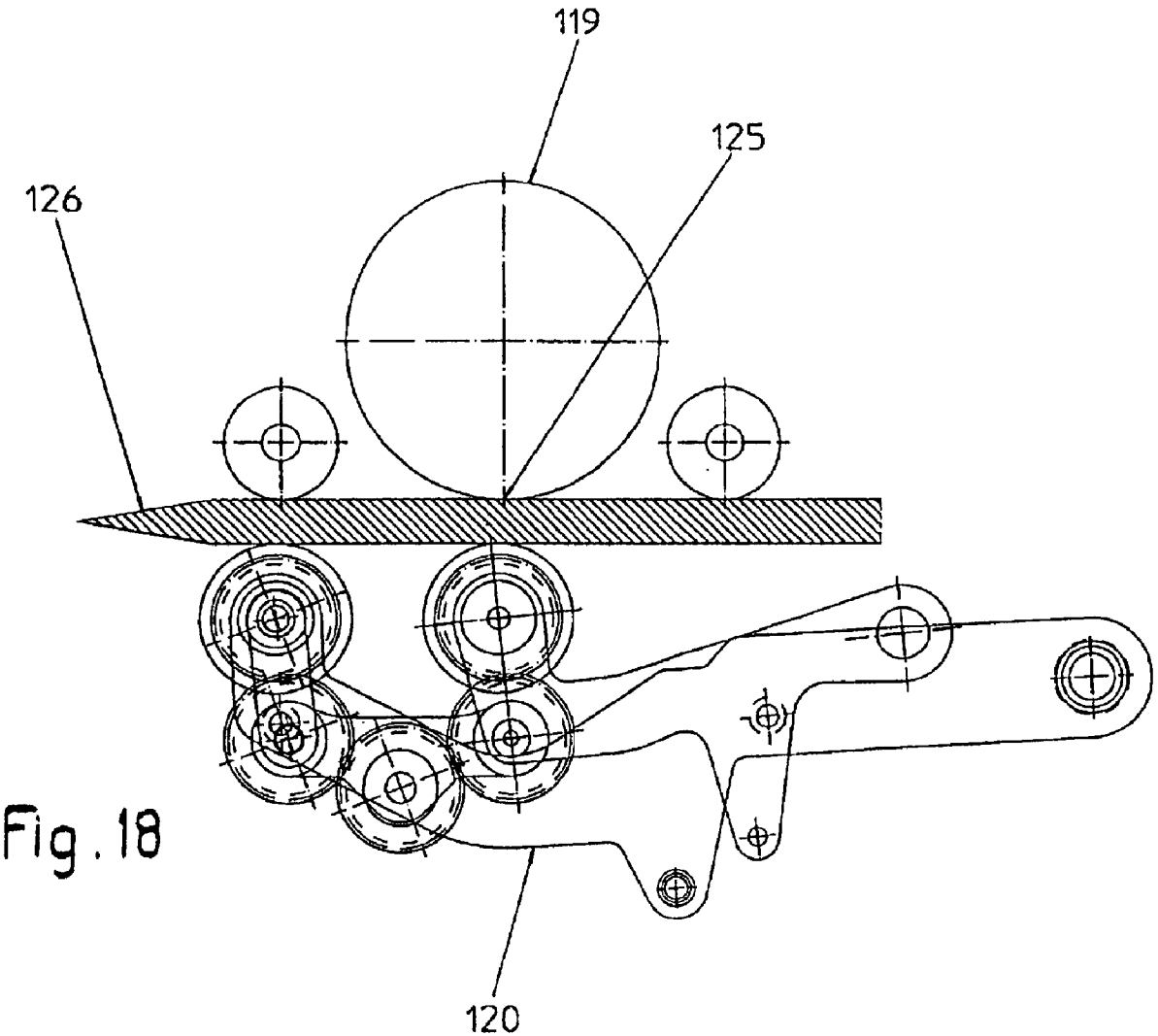
Figure 19:
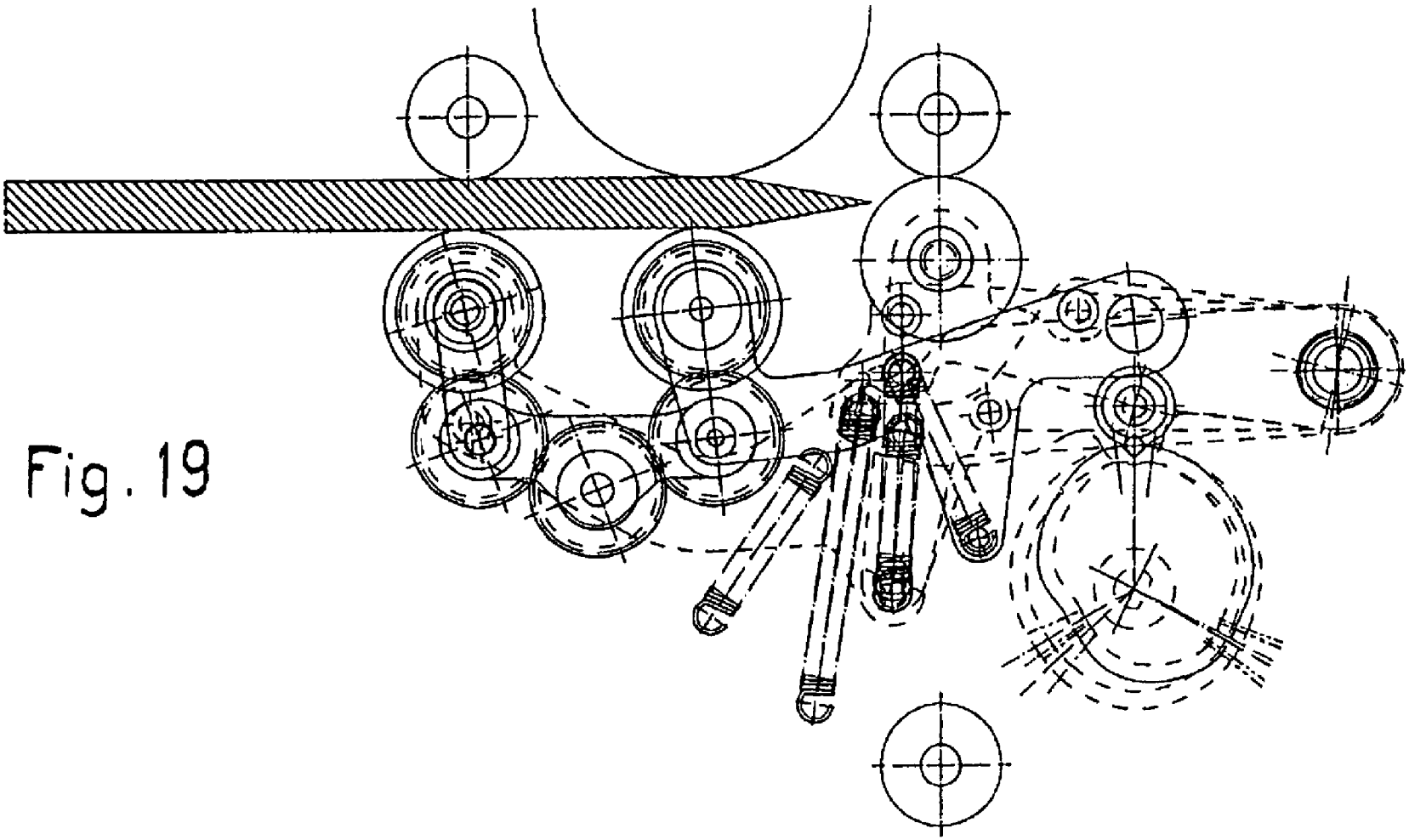
Figure 20:
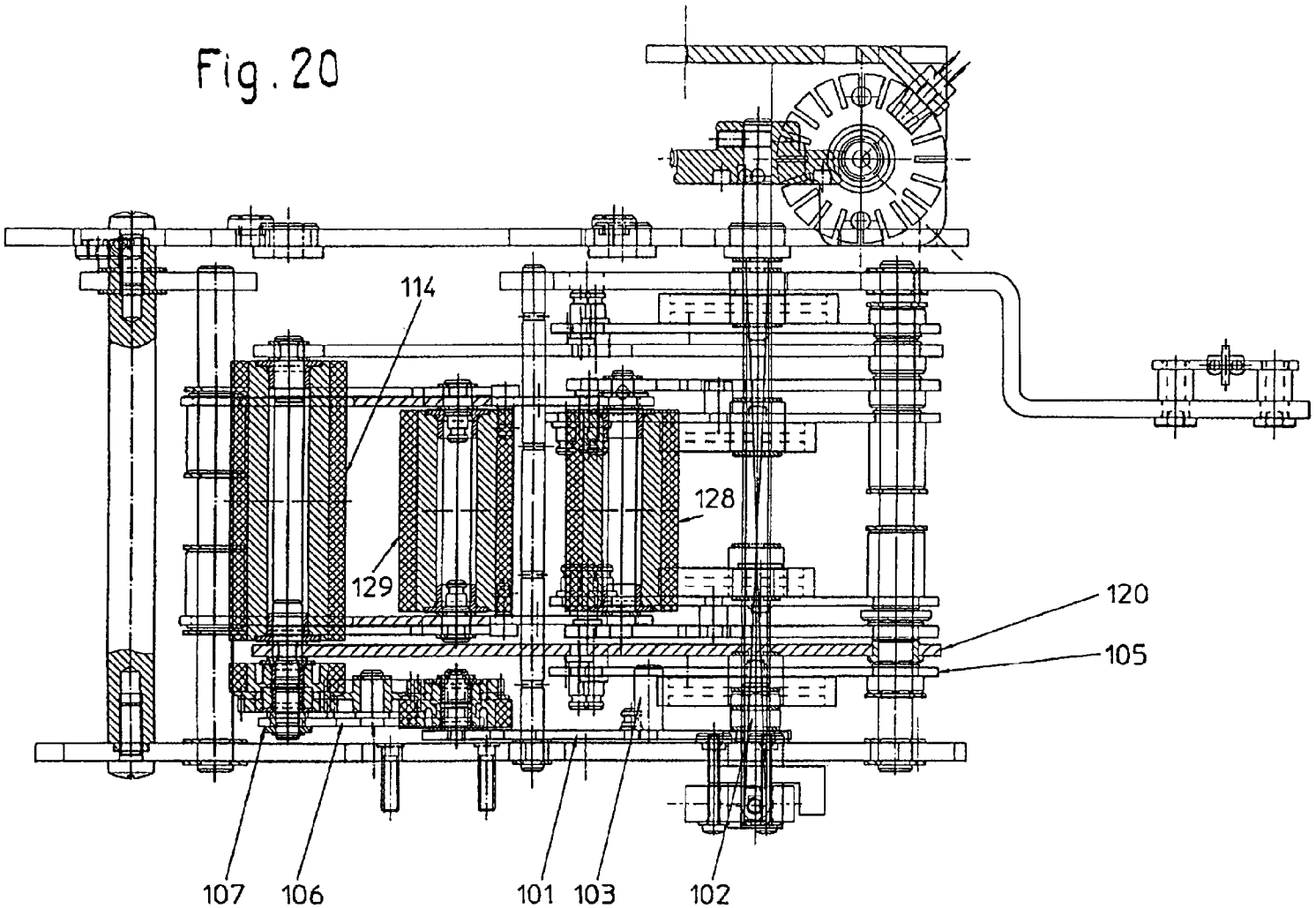
Figure 21:
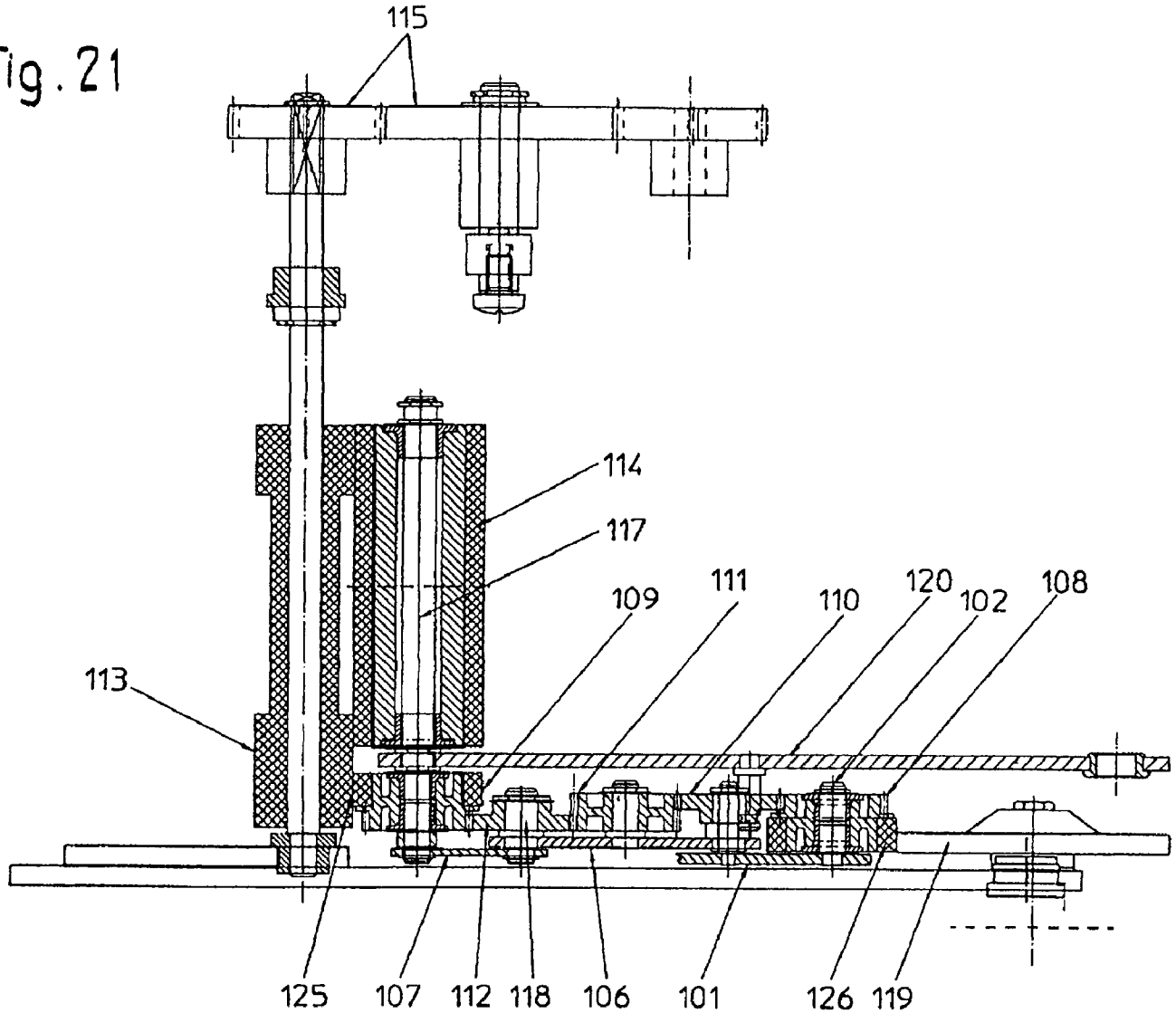
Figure 24:
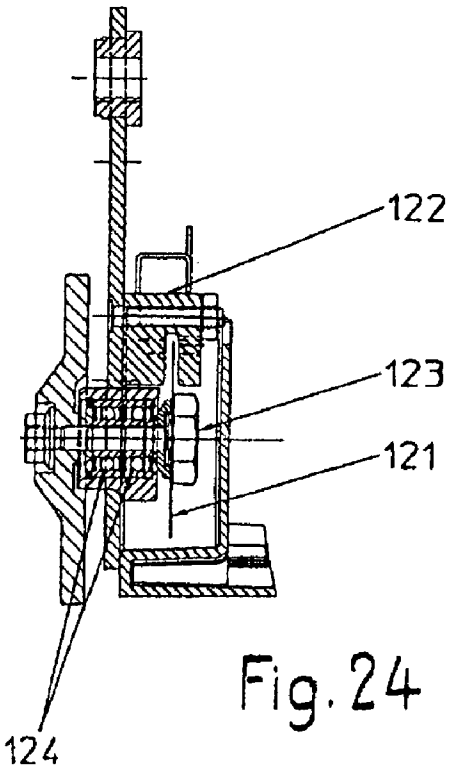
Figure 23:
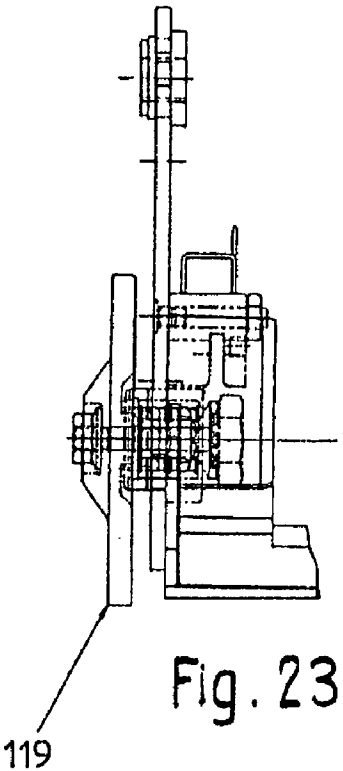
Figure 22:
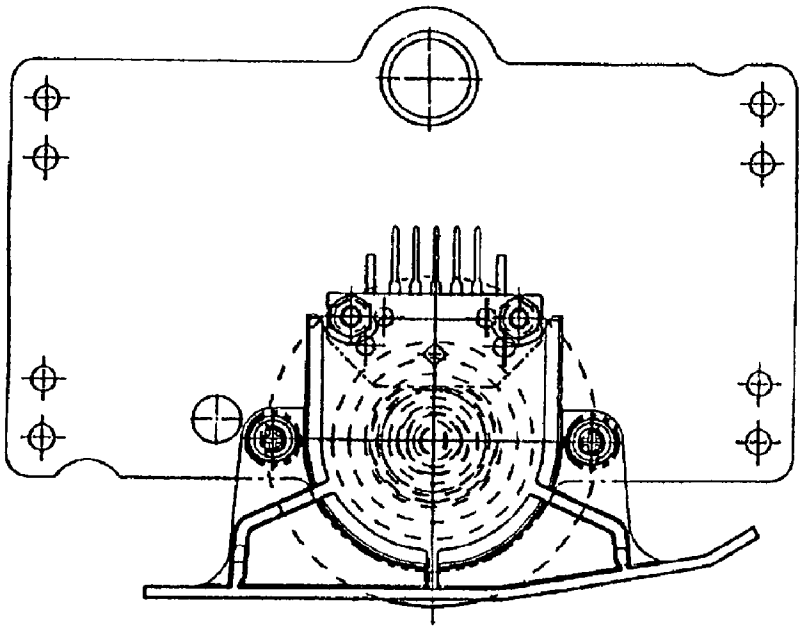

101 counterpressure lever for driven incremental transponder
102 axis of rotation for counterpressure lever
103 stop bolt as follower stop for control lever 105
104 stop edge for stop bolt 103
105 control lever
106 connecting bracket for intermediate wheels
107 connecting bracket to the axle of the left counterpressure roller
108 driven friction wheel of incremental transponder sensing wheel
109 friction wheel for left counterpressure roller
110 intermediate wheel
111 intermediate wheel
112 intermediate wheel
113 drive roller—left
114 counterpressure roller—left
115 gear mechanism for feed drive
116 tensions spring between incremental transponder counterpressure lever and control lever
117 axle of left counterpressure roller
118 axle for intermediate wheel
119 sensing wheel for incremental transponder
120 counterpressure lever—left
121 encoder disc
122 encoder
123 axle for encoder disc
124 ball bearing
125 friction pair drive roller 113 and friction wheel 109
126 friction pair friction wheel 108 and sensing wheel 119
127 drive roller—right
128 counterpressure roller—right
129 support wheel
130 letter
131 axle for friction wheel Contents of Drawings of the Following Figures:

FIG. 9 front view of the complete counterpressure mechanism, including drive, driven incremental transponder counterpressure arrangement, sensing wheel and main shaft drive. Counterpressure lever in the position "manual insertion";

FIG. 10 front view of the complete counterpressure mechanism, including drive, driven incremental transponder counterpressure arrangement, sensing wheel and main shaft drive; counterpressure lever in the uppermost position "franking";

FIGS. 11+12 counterpressure mechanism released;

FIGS. 13+14 released driven counterpressure mechanism of the incremental transponder;

FIG. 15 front view, letter is underneath the right drive roller and has not yet reached the sensing wheel, sensing wheel is driven indirectly by means of left drive roller, friction wheels, and intermediate wheels;

FIGS. 16+17 counterpressure mechanism released;

FIG. 18 front view, envelope underneath both drive rollers, sensing wheel driven directly by the letter surface;

FIG. 19 front view, envelope has left right drive roller, drive is realized now by means of the left drive roller, sensing wheel driven directly by the letter surface;

FIG. 20 plan view of the complete counterpressure mechanism;

FIG. 21 developed view of the driven incremental transponder counterpressure arrangement in section; and FIGS. 22-24 details of sensing wheel with encoder.

As a result of the short letter problems and the space requirements for the print heads in printing stations of a franking machine, in particular, an ink jet printing mechanism, drive rollers are required so that the envelope during the printing process is clamped always underneath one drive roller. The right drive roller drives the envelope when entering the printing area, the left roller carries on transportation downstream of the printing area. The speed and position monitoring of the envelope on one of the two rollers would have the disadvantage that the short letter within a certain travel distance, i.e., at the beginning or the end of the envelope, would no longer be monitored. For the quality of the print image it is moreover required to know the exact letter speed. A speed detection on a driven shaft would have the disadvantage that not necessarily the letter speed is detected, when, for example, the letter has transport slip or is stopped or when a jam problem occurs. The speed or position monitoring is carried out in the device described here by means of a separate sensing wheel which drives directly an encoder disc. The encoder disc and the sensing wheel are arranged precisely between the drive rollers at the center of the two print heads. The signals are evaluated by means of an encoder. The exact starting position for manual insertion of the letter is provided by a reflection light barrier which determines the position of the right edge of the letter. For an automatic letter feed, this zero signal is supplied by a forked light barrier of a peripheral automatic feed. Beginning with this start signal, the sensing wheel must then sense the precise position of the letter. Since for manual insertion or automatic supply the letter has not reached the sensing wheel when the zero position is triggered and can therefore not provide driving action, this must be realized for a short travel distance by means of the driven sensing counterpressure. The pressure of the driven counterpressure roller on the sensing wheel or the left drive roller is realized by a curve-controlled mechanism of the remaining counterpressure levers or rollers. By means of two friction wheels and several intermediate wheels the speed of the left drive roller is transmitted onto the sensing wheel. The left and the right drive rollers are fixedly coupled by means of a spur gear system so that the speed of the letter driven by the right roller coincides with the speed of the left driven roller. Small differences are inconsequential because printing has not yet begun. As soon as the letter, for example, a short letter, driven by the right drive roller, reaches a location underneath the sensing wheel, the speed of the driven counterpressure arrangement is inconsequential. The sensing wheel is driven by friction between the letter surface and sensing wheel periphery with identical speed. The counterpressure roller having acted previously as a friction wheel drive now only provides a pressing function because the envelope has been pushed between the friction partners. As a function of the length of the letter or the label length, the printing process begins at the letter position determined therefor. Corresponding to the respective envelope position the print heads spray a line pattern which results in the corresponding overall print image. After a certain travel distance the envelope leaves the right drive roller and is now moved only by the left drive roller. The sensing wheel senses the speed up to the end of the letter. Approximately 10 mm before the end of the envelope printing is complete.

The counterpressure lever 101 of the driven incremental transponder is rotationally supported on a rotary axle 102 riveted onto the sidewall. The up and down movement of the counterpressure lever is realized in connection with the remaining counterpressure levers. This function will be explained separately. The counterpressure lever 101 is moved upwardly and downwardly by means of the riveted stop bolt 103 and by means of the stop edge 104 of the control lever 105. The overstroke of the control lever is compensated up to the point of contact of the friction wheel 108 at the sensing wheel 119 by means of the tension spring 116.

The friction wheel 108 is rotationally supported on the riveted rotary axle 131. By means of two connecting brackets 106, 107 the left counterpressure lever 120 and the counterpressure lever 101 are connected with one another so as to be rotatable and ensure that the connecting gear mechanism has a constant axle spacing while providing at the same time a rotational degree of freedom. The friction wheel 109 which is seated on the same axle 117 as the counterpressure roller 114 is driven by the left drive roller 113 (friction pair 125). Via the spur gears 112, 111, 110 the friction wheel 108 is driven with the same rotational speed (friction pair 126). Upon triggering the franking machine, the counterpressure levers are lifted upwardly to such an extent until the corresponding counterpressure rollers contact the drive rollers and the sensing wheel. At the beginning of the franking process, the short letter is driven only by the right drive roller 127 and pressed against by the right counterpressure roller 128. The drive of the sensing wheel is realized up to the point in time when the envelope reaches the area between friction wheel 108 and sensing wheel 119, through the gear chain from the left drive roller via friction and intermediate wheels to the sensing wheel. As soon as the letter is positioned under the sensing wheel 119 and is pressed against it by the friction wheel 108, only the speed of the letter surfaces is important for the circumferential speed of the sensing wheel. This means that the exact letter speed is detected. The sensing surface of the sensing wheel (mantle surface) can be made rough, knurled or the like for increasing grip.

When automatic feeding is performed, the driven counterpressure arrangement of the incremental transponder has also the advantage that the sensing wheel must not be accelerated by the letter which is supplied by the feed device. This feature is inconsequential in regard to manual supply because all rotating parts are accelerated simultaneously from their standstill position.

The sensing wheel 119 is seated together with the slotted encoder disc 121 on the axle 123 which is supported by means of two precision ball bearings. The encoder 122 senses the signals and transmits them to an electronic control device. The quality of the sensing action of the letter speed and of the position is of enormous importance for the print quality. The temporal sequence of spraying of the line print pattern is carried out as a function of the letter speed and thus of the letter position.

The invention claimed is:

1. Franking machine with at least one print head of an inkjet print mechanism for printing flat postal objects such as letters or postcards insertable into or passing through the machine, comprised of a guide part arranged so as to project about the print head and further relative to its jet opening plane, having correlated therewith a transport device for transporting the postal objects between it and oppositely positioned conveying rollers rotating about axes oriented transverse to the conveying direction, wherein the transport device has two drive rollers connected in driving connection with one another and forming together with the guide part a conveying path, which drive rollers, when viewed in the conveying direction, are arranged before and behind the print head, and has a counterpressure roller arranged opposite thereto, respectively, which exerts a pressure against one drive roller or the postal object transported therebetween and which is reversibly liftable, wherein a sensing wheel (38, 119) is arranged between the drive rollers (32, 33; 127, 113) which sensing wheel is driven by the postal object passing along it and is correlated with an encoding device (122) for the purpose of speed and position monitoring of a postal object to be transported, respectively, for controlling printing on a postal object, wherein the encoding device (122) is connected to a control unit connected to a computer, wherein the sensing wheel (38, 119) is in drive connection with the drive roller (33, 113) arranged downstream in the conveying direction.

2. Machine according to claim 1, wherein, laterally to the counterpressure roller (15, 114) cooperating with the drive roller (33, 113), a friction wheel (109) is provided which is concentric to and freely rotatingly supported relative to the counterpressure roller and can be brought into drive connection by the counterpressure levers (6A, 6B; 120) with the drive roller (33, 113), which friction wheel drives a further friction wheel (126) by means of an intermediate gear formed of intermediate wheels, the further friction wheel being in drive connection with the sensing wheel (38, 119).

3. Machine according to claim 2, wherein the further friction wheel (126) is supported with the counterpressure roller (115, 114) on a multi-part lever (101) and is movable against the sensing wheel (38,119) counter to a spring force.

* * * * *